US007789153B2

(12) United States Patent
Prinz et al.

(10) Patent No.: US 7,789,153 B2
(45) Date of Patent: Sep. 7, 2010

(54) METHODS AND APPARATUSES FOR ELECTRONIC TIME DELAY AND SYSTEMS INCLUDING SAME

(75) Inventors: Francois X. Prinz, Henderson, NV (US); John A. Arrell, Jr., Lincoln University, PA (US); Ronald S. Borja, Newark, DE (US); William J. Slade, Newark, DE (US)

(73) Assignee: Alliant Techsystems, Inc., Edina, MN (US)

( * ) Notice: Subject to any disclaimer, the term of this patent is extended or adjusted under 35 U.S.C. 154(b) by 417 days.

(21) Appl. No.: 11/876,841

(22) Filed: Oct. 23, 2007

(65) Prior Publication Data

US 2008/0110612 A1 May 15, 2008

Related U.S. Application Data

(63) Continuation-in-part of application No. 11/553,361, filed on Oct. 26, 2006.

(51) Int. Cl.
*E21B 43/1185* (2006.01)

(52) U.S. Cl. ..... 166/297; 102/222; 102/276; 166/55.1; 175/4.54

(58) Field of Classification Search ..... 166/297, 166/55.1; 175/4.54; 102/222, 276
See application file for complete search history.

(56) References Cited

U.S. PATENT DOCUMENTS

| | | | |
|---|---|---|---|
| 2,739,535 | A | 3/1956 | Rolland et al. |
| 3,358,600 | A | 12/1967 | Griffith et al. |
| 3,391,263 | A | 7/1968 | Young |
| 4,324,182 | A | 4/1982 | Kirby et al. |
| 4,614,156 | A | 9/1986 | Colle, Jr. et al. |
| 4,753,170 | A | 6/1988 | Regalbuto et al. |
| 4,762,067 | A | 8/1988 | Barker et al. |
| 4,763,519 | A | 8/1988 | Comeau |
| 4,969,525 | A | 11/1990 | George et al. |
| 5,159,145 | A | 10/1992 | Carisella et al. |
| 5,216,325 | A | 6/1993 | Patel et al. |
| 5,301,755 | A | 4/1994 | George et al. |
| 5,490,563 | A | 2/1996 | Wesson et al. |
| 5,513,570 | A | 5/1996 | Mulcahy |

(Continued)

OTHER PUBLICATIONS

Partial PCT International Search Report for International Application No. PCT/US2007/082641, mailed June 20, 2008.

*Primary Examiner*—Hoang Dang
(74) *Attorney, Agent, or Firm*—TraskBritt

(57) ABSTRACT

Electronic time delay apparatuses and methods of use are disclosed. An explosive or propellant system, which may be configured as a well perforating system includes an electronic time delay assembly comprising an input subassembly, an electronic time delay circuit, and an output subassembly. The input subassembly is activated by an external stimulus, wherein an element is displaced to activate an electronic time delay circuit. The electronic time delay circuit comprises a time delay device coupled with a voltage firing circuit. The electronic time delay circuit counts a time delay, and, upon completion, raises a voltage until a threshold firing voltage is exceeded. Upon exceeding the threshold firing voltage, a voltage trigger switch will break down to transfer energy to an electric initiator to initiate an explosive booster within the output subassembly. The explosive booster provides the detonation output to initiate the next element explosive or propellant element, such as an array of shaped charges in the well perforating system.

25 Claims, 9 Drawing Sheets

U.S. PATENT DOCUMENTS 5,551,520 A 9/1996 Bethel et al.
5,587,550 A 12/1996 Willis et al.
5,598,894 A * 2/1997 Burleson et al. ..... 175/4.52
5,908,365 A 6/1999 LaJaunie et al.
6,131,516 A 10/2000 Sanford et al.
6,497,288 B2 12/2002 George et al.
6,618,237 B2 9/2003 Eddy et al.
2005/0145393 A1 7/2005 Lerche et al.
2005/0178282 A1 8/2005 Brooks et al.
2006/0196665 A1 9/2006 LaGrange et al.

* cited by examiner

METHODS AND APPARATUSES FOR ELECTRONIC TIME DELAY AND SYSTEMS INCLUDING SAME

RELATED APPLICATIONS

This application is a continuation-in-part of U.S. patent application Ser. No. 11/553,361 entitled METHODS AND APPARATUSES FOR ELECTRONIC TIME DELAY AND SYSTEMS INCLUDING SAME filed Oct. 26, 2006, pending, the disclosure of which is hereby incorporated by reference.

FIELD OF THE INVENTION

This invention, in various embodiments, relates generally to time delay apparatuses and, more specifically, to apparatuses comprising an electronic time delay assembly suitable for use in initiating explosives and propellants, as well as systems including an electronic time delay system and methods of operation thereof.

BACKGROUND OF THE INVENTION

Perforating systems used for completing an oil or gas well are well known in the art. Well bores, which are drilled through earth formations for extracting hydrocarbons in the form of oil and gas, are conventionally lined by inserting a steel casing or liner into the well, and cementing at least a portion of the casing or liner in place to prevent migration of high pressure fluids up the well bore outside the casing or liner. The subterranean formation or formations having the potential to produce hydrocarbons are directly linked with the interior of the casing or liner by making holes, referred to as perforations, through the wall thereof, through surrounding cement and into the formation. Perforations are conventionally made by detonating explosive shaped charges disposed inside the casing at a location adjacent to the formation which is to produce the oil or gas. The shaped charges are configured to direct the energy of an explosive detonation in a focused, narrow pattern, called a "jet," to create the holes in the casing.

Conventionally, well perforation systems include a firing head and a perforating gun, both of which are suspended from, and lowered into, a well on a conveyance device such as a tubular string which may comprise so-called "coiled tubing." Well perforation systems also conventionally comprise various components including, for example, a packer, a firing pin, an explosive booster, and a time delay device. A time delay device is needed to provide an operator sufficient time between a pressurizing event and a subsequent perforation event in order to pressure balance a well for perforation to secure optimal flow of oil or gas flow into the well. Pressure balancing a well is an important procedure because failure to do so, or if the procedure is done incorrectly, may lead to equipment damage as well as possible injury to equipment operators if insufficient hydrostatic pressure is present in the casing or liner or, if too great a hydrostatic pressure is present, the producing formation exposed by the perforating operation may be contaminated or production compromised or prevented without remedial measures. Additionally, with a properly pressure-balanced well, producing formation fluid will immediately and rapidly flow upward through the interior of the tubular string and toward the earth's surface in an appropriate, controlled manner. Therefore, it is important that the timing delay device employed be reliable and accurate in order to allow for adequate time to pressure balance a well. Time delay devices currently used in the art employ pyrotechnic time delay fuses. As described below in greater detail, pyrotechnic fuse-based time delay devices have reliability and accuracy concerns, as well as time limitations which may eventually lead to greater complexity and increased costs for customers of the oil tool industry.

FIG. 1 illustrates a conventional well perforating system 20 within well 10. The well 10 is constructed by first drilling a well bore 12, within which a well casing 14 is placed and cemented in place as indicated at 16. The perforating gun 34, mechanical release 28, packer 24, and firing head 32 are, among other components, carried by tubular string 22. The perforating gun 34 and firing head 32 are lowered on the tubular string 22 to a selected location in the well 10 adjacent to the subsurface formation 18 which is to be produced. A seal is provided by packer 24 between the exterior of tubular string 22 and wall 38 of casing 14 to define a well annulus 40 above packer 24 and an isolated zone 42 below packer 24. Perforating system 20 also includes a vent 56 located below packer 24. Vent 56 allows for a direct link between the isolated zone 42 and tubing bore 58 to ensure fluid pressure within tubing bore 58 and isolated zone 42 are substantially equal. At the time designated to fire the perforating gun 34, an actuating piston 50 within firing head 32, is moved in response to an increase in fluid pressure in tubular string 22 initiated by the operator. The movement of the piston 50 releases a firing pin 52, thus initiating a firing sequence.

As mentioned above, conventional perforating systems may provide for a pyrotechnic time delay device 30 located within firing head 32. The pyrotechnic time delay device 30 provides for a time delay between the initiation of the firing head 32 and the subsequent firing of the shaped charges carried by the perforating gun 34 in order to, as described above, pressure balance the well 10 for optimal perforation. Pyrotechnic time delay devices as known in the art provide a maximum time delay of eight minutes. Therefore, in order to achieve longer delays, an operator is forced to string multiple pyrotechnic time delay devices together in a series formation. For example, additional delays may be coupled together so as to achieve a longer delay timer.

Due to the time and expense involved in perforating well bores and the explosive power of the devices used, it is essential that their operation be reliable and precise. Stringing together multiple pyrotechnic time delay devices diminishes the system's reliability and increases the system cost and complexity.

There is a need for methods and apparatuses to provide increased system reliability and flexibility of operation of well perforating systems. Specifically, there is a need for a time delay device used in a well perforating system to allow for adequate and precise timing of operation of a well perforating system in order to pressure balance a well for optimal perforation results. Such a time delay device would desirably exhibit a high level of reliability at a low level of cost and complexity of fabrication.

BRIEF SUMMARY OF THE INVENTION

An embodiment of the present invention comprises a time delay apparatus comprising an input assembly including an element positioned to be displaced to enable a power source connection. The time delay apparatus further includes an electronic time delay circuit operably coupled to the input assembly and configured to provide a time delay responsive to the enabled power source connection and initiate a fire command upon completion of the time delay.

Another embodiment of the present invention includes a well perforation system including a conveyance device, a perforating gun suspended from the conveyance device, a firing head suspended from the conveyance and operably coupled to the perforating gun, and a time delay apparatus within the firing head. The time delay apparatus includes an input assembly including an element positioned to be displaced to enable a power source connection, an electronic time delay circuit operably coupled to the input assembly and configured to provide a time delay responsive to an enabled power connection and initiate a fire command upon completion of the time delay.

Another embodiment of the present invention includes a method of using an electronic time delay apparatus within an explosive or propellant system. The method comprises applying an external force to an element to displace the element responsive to the external force, connecting a power source to an electronic time delay circuit responsive to the displacement of the element, providing an electronic time delay responsive to connection of the power source; and increasing a voltage from the power source to a predetermined, higher threshold firing voltage after the electronic time delay.

Another embodiment of the present invention includes a time delay apparatus comprising an input assembly including an element positioned to be displaced to enable a power source connection and an electronic time delay circuit. The electronic time delay circuit includes an isolation element configured to electrically isolate a power source from the electronic time delay circuit that is operably coupled to the input assembly and configured to provide a time delay responsive to an enabled, non-isolated power source connection and initiate a fire command upon completion of the time delay.

Yet another embodiment of the present invention includes a well perforation system including a conveyance device, a perforating gun suspended from the conveyance device, a firing head suspended from the conveyance and operably coupled to the perforating gun, and a time delay apparatus within the firing head. The time delay apparatus includes an input assembly including an element positioned to be displaced to enable a power source connection and an electronic time delay circuit. The electronic time delay circuit includes an isolation element configured to electrically isolate a power source from the electronic time delay circuit that is operably coupled to the input assembly and configured to provide a time delay responsive to an enabled, non-isolated power source connection and initiate a fire command upon completion of the time delay.

Still, another embodiment of the present invention includes a method of disabling an electronic time delay circuit. The method comprises providing an isolation element connected between a power source and an electronic time delay circuit and isolating the power source from the electronic time delay circuit responsive to a component of the isolation element contacting a liquid.

DETAILED DESCRIPTION OF THE INVENTION

The present invention, in various embodiments, comprises apparatuses and methods of operation for an electronic time delay assembly suitable for use within an explosive or propellant system configured, by way of nonlimiting example, as a well perforating system to address the reliability concerns, as well as the cost and complexity issues associated with conventional time delay devices.

In the following description, circuits and functions may be shown in block diagram form in order not to obscure the present invention in unnecessary detail. Conversely, specific circuit implementations shown and described are examples only and should not be construed as the only way to implement the present invention unless specified otherwise herein. Additionally, block definitions and partitioning of logic between various blocks is exemplary of a specific implementation. It will be readily apparent to one of ordinary skill in the art that the present invention may be practiced by numerous other partitioning solutions. For the most part, details concerning timing considerations and the like have been omitted where such details are not necessary to obtain a complete understanding of the present invention and are within the abilities of persons of ordinary skill in the relevant art.

In this description, some drawings may illustrate signals as a single signal for clarity of presentation and description. It will be understood by a person of ordinary skill in the art that the signal may represent a bus of signals, wherein the bus may have a variety of bit widths and the present invention may be implemented on any number of data signals including a single data signal.

In describing embodiments of the present invention, the systems and elements incorporating embodiments of the invention are described to facilitate an enhanced understanding of the function of the described embodiments of the invention as it may be implemented within these systems and elements.

Figure 1:
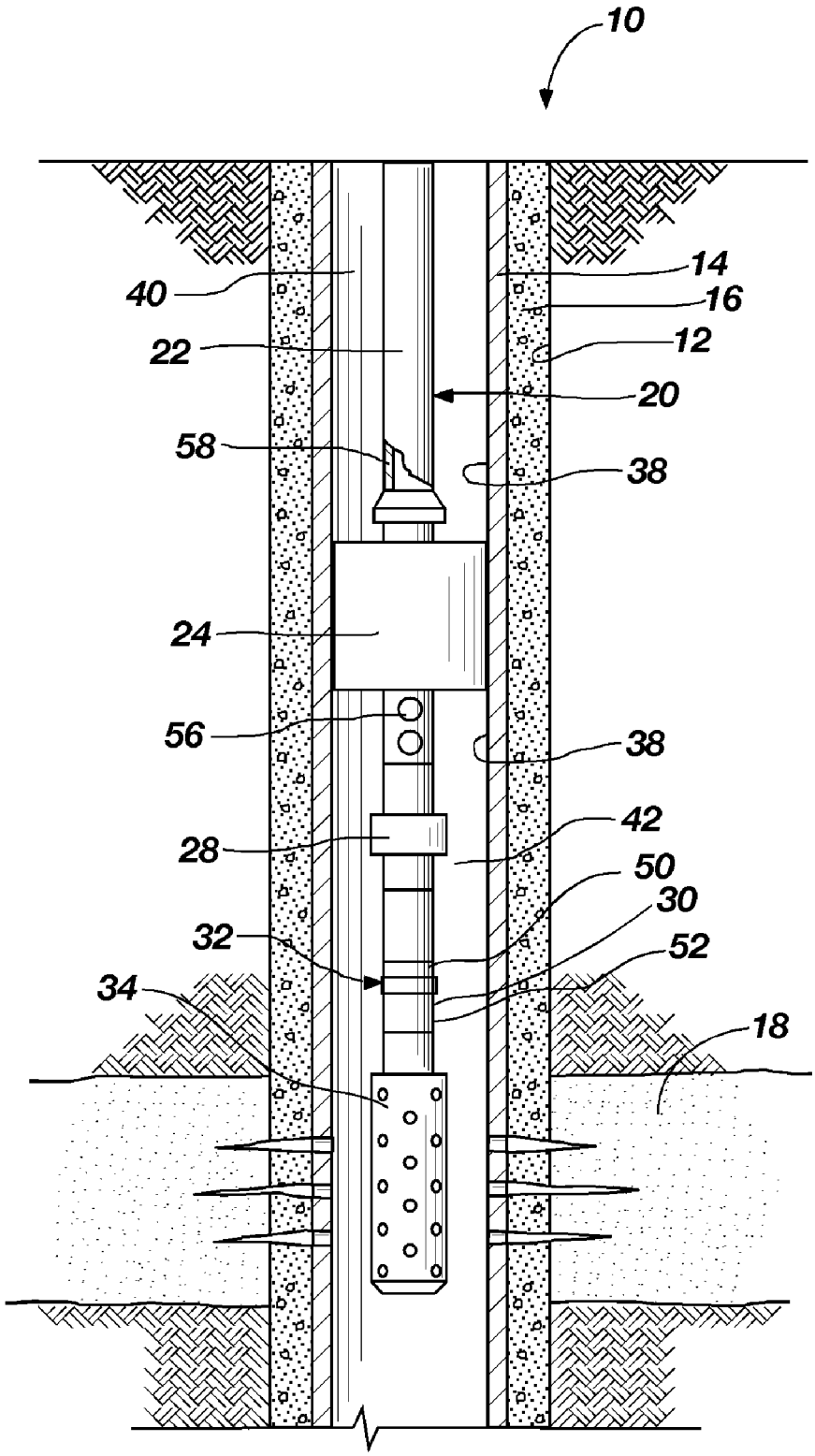
FIG. 1 is a cross-sectional illustration of a conventional perforating system within a well.
Figure 2:
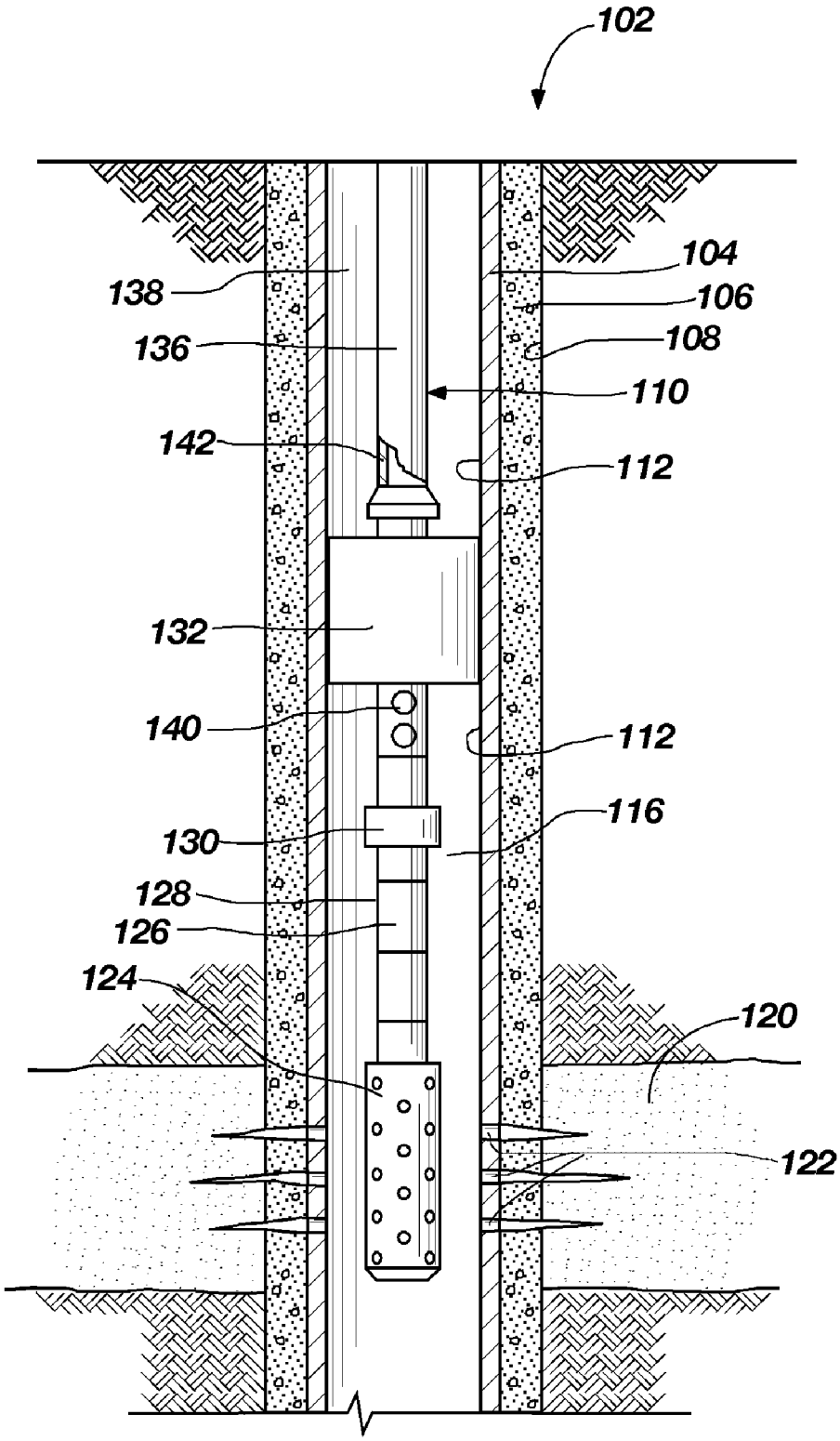
FIG. 2 is a cross-sectional illustration of an explosive or propellant system configured as a well perforating system in accordance with an embodiment of the invention.

FIG. 2 illustrates an embodiment of an explosive or propellant system configured as a well perforation system 110 disposed within a well 102. The well 102 is constructed by first drilling a well bore 108 within which is placed a well casing 104 which is cemented in place as indicated at 106. The well 102 intersects a subsurface formation 120 from which it is desired to produce hydrocarbons such as oil and/or gas. The system 110 includes a conveyance device 136 coaxially inserted inside the casing 104. Conveyance device 136 may be any suitable device, such as a wireline, slickline, tubing string, coiled tubing, and the like. As depicted, conveyance device 136 comprises a tubular string and, for brevity and ease of description, will be referred to herein as a tubing string. The tubing string 136 extends from a drilling rig on the surface through casing 104 and components of a well perforating system, such as packer 132, mechanical release 130, firing head 128, and perforating gun 124, are disposed at the lower, or distal, end thereof.

The packer 132 provides a structure for sealing between the exterior of tubing string 136 and a wall 112 of casing 104 which may also be referred to as a casing bore wall or well bore wall 112. The resulting seal provides a well annulus 138 between the tubing string 136 and well bore wall 112 above the packer 132 and an isolated zone 116 of well 102 below packer 132. Perforating system 110 also includes a vent 140 located below the packer. Vent 140 allows for hydraulic communication between isolated zone 116 and tubing bore 142 to ensure fluid pressures within the tubing bore 142 and isolated zone 116 are substantially equal.

The perforating gun 124 is suspended from the tubing string 136 in the isolated zone 116 adjacent to the subsurface formation 120 which is to be perforated. The perforating gun 124 is configured to detonate and fire shaped charges to create holes, or perforations 122, in casing 104 and into the surrounding cement 106 and formation 120. FIG. 2 illustrates a well perforating system at a time subsequent to the detonation of perforation gun 124; therefore casing 104, cement 106 and formation 120 include perforations 122 extending therethrough. When the tubing string 136 and the components of well perforating system are first lowered into the well 102, the perforations 122 illustrated in FIG. 2 will not be present. The mechanical release 130 enables an operator to drop the perforating gun 124 to the bottom of well 102 after the perforating gun 124 has been fired.

Also suspended from the tubing string 136 and located above the perforating gun 124 is the firing head 128. Firing head 128 includes, among other components, an electronic time delay assembly 126 according to an embodiment of the invention. As described in detail below, electronic time delay assembly 126 provides multiple safety features including various circuit and trigger isolation features as well as mechanical isolation features. Additionally, the electronic delay assembly 126 provides a time delay so as to allow an operator sufficient time to pressure balance well 102 for optimal perforation. Stated another way, the time delay allows time for an operator to alter the pressure in isolated zone 116 to the requirements of the formation fluids in formation 120. Electronic time delay assembly 126 provides this delay time capability by enabling longer, and more highly selectable, time delays in comparison to conventional pyrotechnic time delay fuses. By way of example only, electronic time delay assembly 126 may provide a selected time delay duration of up to, for example, at least ten hours.

Figure 3:
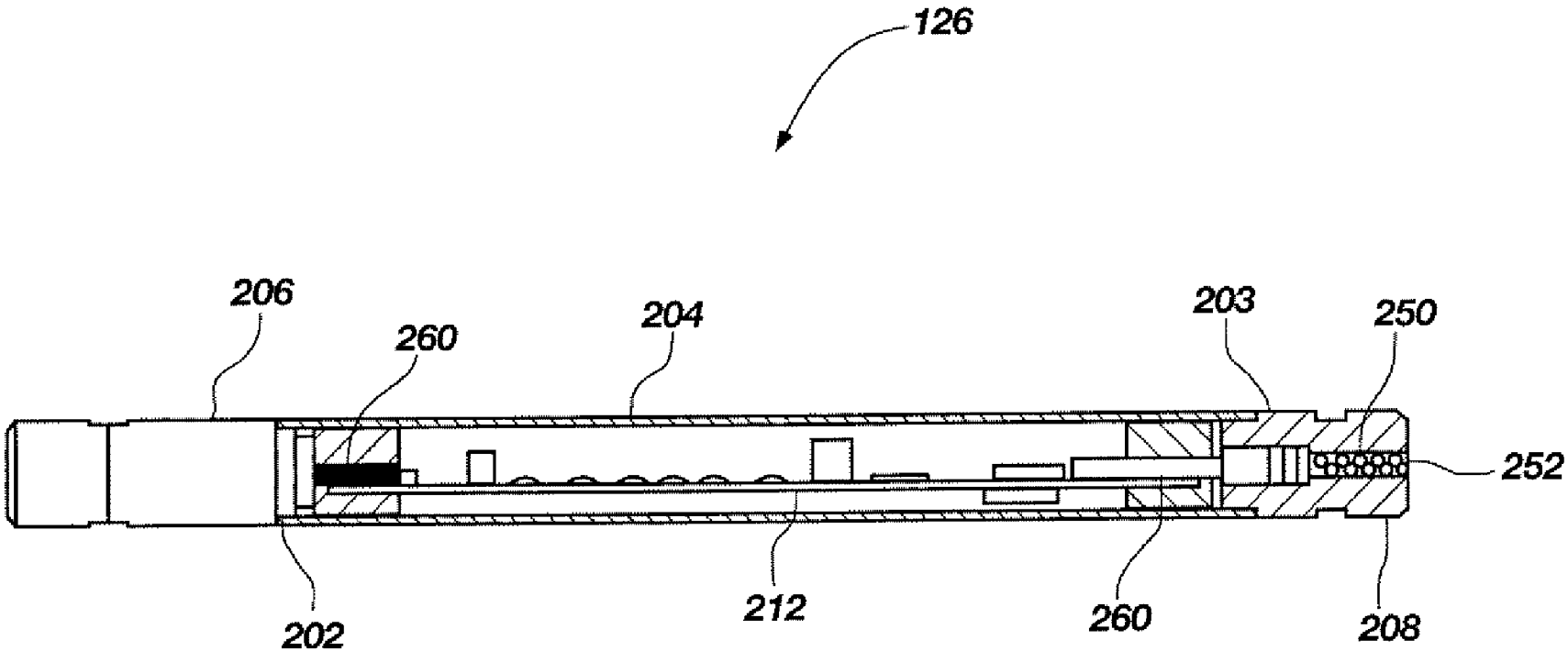
FIG. 3 is a cross-sectional illustration of an electronic time delay assembly in accordance with an embodiment of the invention.

FIG. 3 illustrates an electronic time delay assembly 126 according to an embodiment of the present invention. As described and illustrated in detail below, the electronic timed delay assembly 126 provides significantly improved functions in a well perforating system including providing a reliable and increased time delay, increasing the duration of time delay, and providing safety features including circuit and explosive booster initiator isolation.

As illustrated in FIG. 3, electronic time delay assembly 126 may include an input module 206, an electronic time delay circuit 212, and an output module 208. Input module 206 may be configured as a firing pin subassembly, while output module 208 may be configured as an explosive booster subassembly. Electronic time delay circuit 212 is contained in a central, tubular housing 204 which may be attached, as by laser welding to input module 206 and output module 208 at locations 202 and 203, respectively. For example only, the tubular housing 204 may be made of steel with resilient retainers 260 at each end of the tubular housing 204. The resilient retainers 260 provide mechanical support as well as electrical and mechanical isolation of the electronic time delay circuit 212. Output module 208, which will be described in greater detail below, may be configured to provide a detonation output to trigger the subsequent firing of perforating gun 124 (see FIG. 2).

Figure 4:
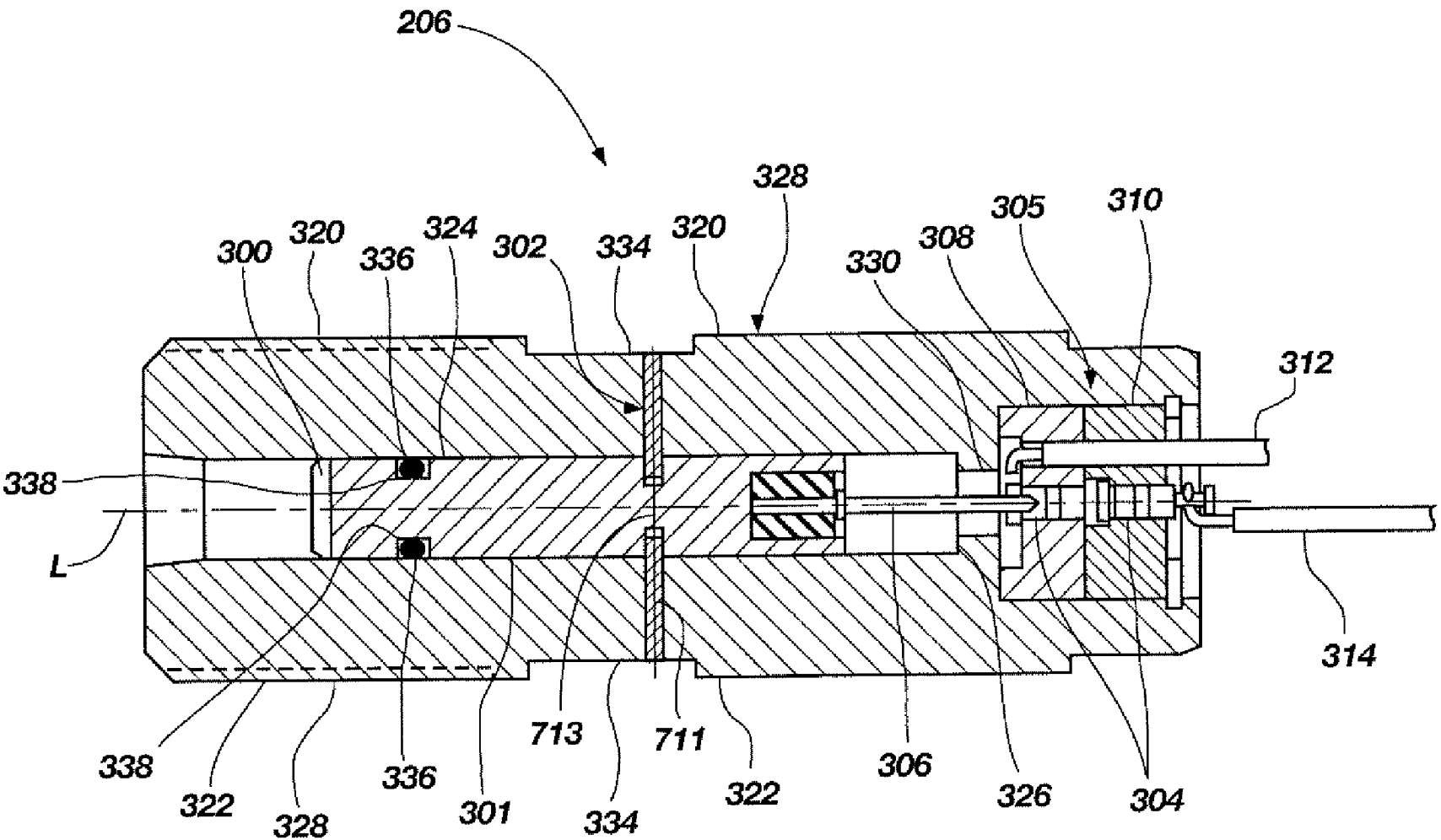
FIG. 4 is a cross-sectional illustration of a firing pin subassembly in accordance with an embodiment of the invention.

FIG. 4 illustrates input module 206 according to an embodiment of the present invention. Input module 206, as illustrated, comprises firing pin 301, a shear pin assembly 302, and a contact assembly 305 carried by housing 328 having a firing pin bore 324 therethrough, firing pin bore 324 necking down to a smaller intermediate diameter bore at 330 and then increasing in diameter at contact assembly 305. Shear pin assembly 302 may include a single shear pin 713 extending transversely across housing 328 or may comprise a double shear pin configuration comprising a first shear pin 713 and a second shear pin 711 each extending into firing pin 301. Shear pin assembly 302 extends from a first side 320 to a second side 322 of input module 206 through firing pin 301 and apertures 334 in the wall of housing 328. By way of example, shear pin assembly 302 may comprise a coiled spring pin. Contact assembly 305 may include a first contact assembly 308, a second contact assembly 310, and annular contact 304 extending through both the first and second contact assembly 308, 310. Lead wires 312 and 314 may protrude from one end of input module 206 and may be operably coupled to electronic time delay circuit 212 (see FIG. 3). Lead wire 312 is connected to an annular contact 304 carried by first contact assembly 308, while lead wire 314 is connected to an annular contact 304 carried by second contact assembly 310.

Firing pin 301, which is disposed in firing pin bore 324, has a longitudinal axis L and may include a pin contact 306 located extending from at one end of firing pin 301. The opposite end 300 of firing pin 301 is configured to receive a firing stimulus from an external force, such as, for example only, hydraulic pressure in isolated zone 116 or an impact force from a dropped weight. As shown, firing pin 301 is configured for pressure actuation and includes an annular seal 336 disposed thereabout in annular groove 338. Sufficient external force acting on firing pin 301, and specifically on end 300, shears pins 711, 713 of shear pin assembly 302 and allows the firing pin 301 to be displaced to the right (as the drawing is oriented), or downwardly within well perforating system 110 (see FIG. 2) and toward contact assembly 305. Upon displacement, the firing pin 301 may then travel a fixed distance down the input module 206, stopping at annular wall 326 which may then enable pin contact 306 to extend further into contact assembly 305. Upon entering contact assembly 305, pin contact 306 engages both electrical contacts 304 and acts as a switch S to connect a power source 408 to the electronic time delay circuit 212 (see FIG. 5). For brevity and ease of description, power source 408 will be referred to herein as a battery 408. Upon connection of the battery 408, electronic time delay circuit 212 will power up, and the desired, selected time delay will begin. Power source 408 may also comprise a capacitor-type power storage device instead of a battery, or power may be provided from an external power source. The type of power source 408 employed is not significant to the practice of the present invention, and an optimum type of power source may vary with the specific embodiment and application of the invention.

As described above, input module 206 acts as an electrical switch that requires an external force or stimulus in order to be activated. This configuration provides for a significant safety feature by isolating the battery 408 from the electronic time delay circuit 212 (FIG. 5) until a satisfactory external force or stimulus is applied. Therefore, any chance of premature detonation is substantially eliminated. The type and magnitude of the required external force or stimulus may vary according to the embodiment and application of the present invention, and is not limited to applied pressure or impact force as discussed above.

Figure 5:
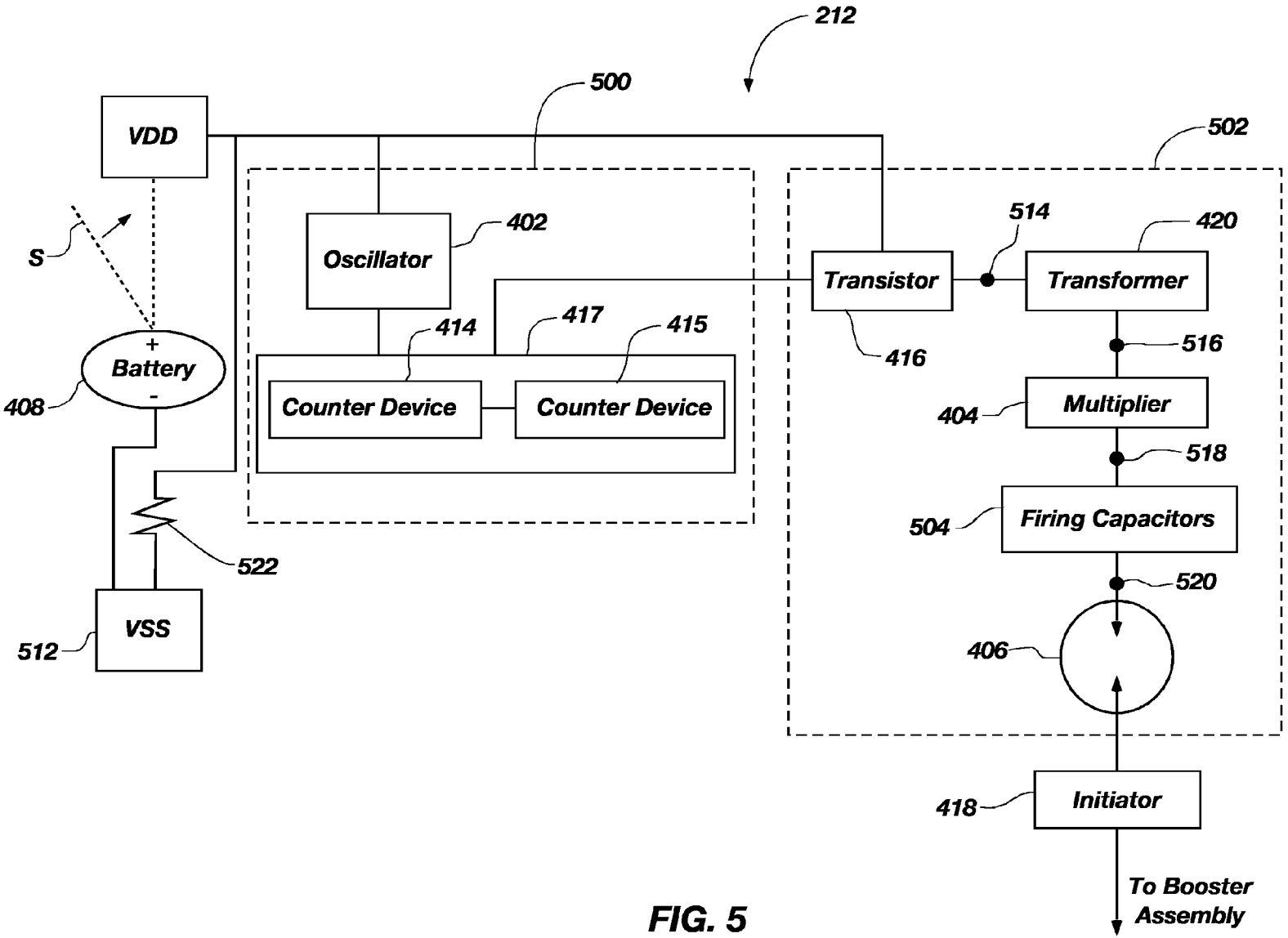
FIG. 5 is a block diagram of an electronic time delay circuit in accordance with an embodiment of the invention.

FIG. 5 illustrates a block diagram of electronic time delay circuit 212 according to an embodiment of the present invention. As described below, circuit 212 comprises an electronic time delay device 500 coupled with a voltage firing circuit 502. Circuit 212 also comprises a battery 408 and supply voltage terminal VDD. As described above in reference to FIG. 4, battery 408 is selectively connectable to supply voltage terminal VDD by way of an electrical switch S provided by electrical contacts 304 in cooperation with pin contact 306. When the pin contact 306 engages annular contact 304, battery 408 is connected to supply voltage terminal VDD, thus connecting electronic time delay device 500 and voltage firing circuit 502 to battery 408. By way of example only, battery 408 may supply a continuous current at an open circuit voltage of below ten volts, one suitable voltage being about 3.90 volts (VDC).

Electronic time delay device 500 comprises an oscillator 402 which oscillates at a selected frequency and is operably coupled with counter device 417. Oscillator 402 and counter device 417 are configured to count a desired time delay. By way of example, and not limitation, oscillator 402 may comprise a 75 KHz crystal oscillator. Counter device 417 may comprise, by way of example only, a pair of CD4060B binary counter/divider devices 414, 415, offered by Texas Instruments of Dallas, Tex. Depending on the desired time delay, a single counter device may be used or multiple counter devices may be coupled together in series to achieve a longer delay. For example, if an eight-minute time delay is desired, a single eight-minute counter device may be used. Similarly, if a thirty-minute time delay is desired, a thirty-minute counter device may be use. On the other hand, if a thirty-minute counter device is unavailable, then a pair of counter devices, with a total delay time of thirty minutes may be coupled in series in an adder configuration to count the desired delay. For example only, one twenty-minute counter/divider device may be coupled with a ten-minute counter, or alternatively, two fifteen-minute counters may be coupled together to produce the desired thirty-minute delay. Alternatively, a pair of counter devices may be coupled in series in a multiplier configuration in order to achieve the desired time delay. For example only, if a thirty-minute time delay is desired using a multiplier configuration, a first device would count up to fifteen minutes and upon completion of the fifteen minutes, a second device would increment to a value of one. Subsequently, the first device would again count up to fifteen minutes, and upon completion, the second device would increment to a value of two. Therefore, in a multiplier configuration example, with a 75 KHz oscillator, the first device is only required to count up to fifteen minutes (67,500,000 clock cycles) and the second device is only required to count to a value of two seconds (150,000 clock cycles).

In one embodiment, oscillator 402 may comprise a quartz crystal oscillator and counter device 417 may comprise at least one CD4060B binary counter/divider device having fourteen flip-flop stages. In this embodiment, with an oscillator frequency of 75 KHz, it is possible to have a frequency of 4.577 Hz (with a time period of 0.21845 seconds) at the fourteenth stage output of a first CD4060B binary counter/divider device (i.e., 75000 Hz/2^14=4.577 Hz). Furthermore, a second CD4060B binary counter/divider device may be used and the 0.21845 time increments may then be counted in binary steps. With counter device 417, the rising edge of the last flip-flop stage, which may be used to issue a fire command, will appear after the prior flip-flop has completed. Therefore, the maximum possible time delay that may be achieved using two CD4060B binary counter/divider devices and a 75 KHz quartz crystal oscillator is 1790 seconds (2^13× 0.21845 seconds). Using two CD4060B binary counter/divider devices and a 75 KHz quartz crystal oscillator, a time delay of 895 seconds may be achieved at the thirteenth stage output and a time delay of 448 seconds may be achieved at the twelfth stage output.

For desired time delays between thirty and sixty minutes, a 36 KHz quartz oscillator may be used. For desired tine delays between sixty and ninety minutes, a 25.6 KHz quartz oscillator may be used. For time delay greater than 90 minutes, a third CD4060B binary counter/divider device may be employed. Thus, one may select the quartz crystal oscillator depending on the desired time delay.

As opposed to conventional pyrotechnic time delays, the embodiment of the invention may, for example only, provide time delays from a short duration such as eight minutes up to a much longer duration of, for example, a number of hours. This capability reduces cost and complexity and increases operational flexibility and reliability in comparison to conventional pyrotechnic fuse-type time delay devices because only one time delay unit and setting and only one detonation transfer event is required. Additionally, because of the high level of accuracy of electrical components, the timing accuracy and precision of an electronic time delay is improved over a conventional pyrotechnic time delay fuse, which may suffer from unpredictable burning rates.

As illustrated in FIG. 5, electronic time delay device 500 is operably coupled to a high voltage generator transistor 416 which may act as a switch and is thereafter operably coupled to a transformer 420. The transformer 420 is in turn operably coupled to a voltage multiplier 404. For example, and not limitation, transformer 420 may be configured to generate a voltage of about 550 VAC with a working frequency of 25 KHz from an input of about 3 VDC, such as a 3 V battery. Multiplier 404 may include a voltage doubler comprising a diode/capacitor pair configuration configured to generate a voltage for a firing pulse from the AC input (1300 V maximum with a 3.3 V battery). Voltage multiplier 404 is operably coupled to firing capacitors 504, which are then operably coupled to the input side of the trigger 406. Firing capacitors 504 comprise, for example, three 0.1 μF capacitors in parallel charged through a 22 Mohms resistor and configured to provide a fire pulse of substantially 600 V (620 V+/−50 V). The output side of the trigger 406 is operably coupled to an initiator 418 which is then operably coupled to the output module 208 (see FIG. 3). By way of example, and not limitation, trigger 406 may comprise a gas discharge tube which will not conduct unless (in the described embodiment) a voltage level of substantially 600 V (620 V+/−50 V) or above is applied across the tube. In some cases, it may be desirable for trigger 406, or a gas discharge tube, to comprise a different breakdown voltage. Therefore, in one embodiment, voltage multiplier 404 may comprise a voltage quadrupler configured to generate a voltage of substantially 2500 V.

The operation of circuit 212 illustrated in FIG. 5 will now be described. After pin contact 306 within input module 206 engages both electrical contacts 304 (see FIG. 4), battery 408 is connected to the circuit 212, thus starting the desired, selected time delay. The desired, selected time delay is provided using oscillator 402 in conjunction with a counter device 417. As described above, the time delay may be programmed or preselected by using one or more counter/divider devices to produce the desired time delay. Upon completion of the desired, selected time delay, electronic time delay device 500 issues a fire command at the gate of the high voltage generator transistor 416. Subsequently, the battery voltage at node 514 is input into transformer 420 and transformer 420 generates a first intermediate voltage at node 516 that is substantially higher than the battery voltage at node 514. Thereafter, the first intermediate voltage at 516 is input into voltage multiplier 404 and voltage multiplier 404 generates a second intermediate voltage at node 518 that is substantially higher than that at the first intermediate voltage at node 516. Firing capacitors 504 are then charged and, upon reaching a threshold firing voltage at node 520, firing capacitors 504 apply a pulse to an initiator 418 through the trigger 406. By way of example only, trigger 406 may have a breakdown voltage of 600 V. Therefore, as the voltage in firing capacitors 504 reaches 600 V, trigger 406 breaks down and the voltage is applied across trigger 406 and at initiator 418, which then initiates an explosive booster contained in booster subassembly 208 (see FIG. 3).

Trigger 406 provides a significant safety feature of the embodiment of the invention by isolating the initiator 418 from the circuit 212 which, in turn, provides isolation and safety from electrostatic discharge (ESD) and stray voltage which could result in premature detonation. As a further safety feature, the oscillator 402 of circuit 212 may be configured to continue oscillating after the time delay has passed and after a voltage is applied at initiator 418. Therefore, any residual energy stored in battery 408 will be drained by the charging and de-charging oscillator. Additionally, one embodiment of the invention may comprise a resistor 522 operably coupled between battery 408 and a ground voltage VSS 512. Therefore, any residual energy stored in battery 408 may be drained to ground voltage VSS 512 through resistor 522.

Whereas one embodiment of the electronic time delay circuit 212 is shown in FIG. 5, various other circuit designs, including a time delay device and a voltage firing circuit are within the scope of the invention.

Returning to FIG. 3, in one embodiment of the invention, output module 208 provides the detonation output to initiate the perforating gun 124 (see FIG. 2). Output module 208 may comprise an output charge 250 and a prime charge 252. By way of example only, output module 208 may comprise 730 milligrams (mg) of hexanitrostilbene (HNS) output charge 250 and 200 mg of lead azide prime charge 252. For example, and not limitation, output module 208 may be configured, upon detonation, to initiate subsequent explosive or propellant train events.

Figure 6:
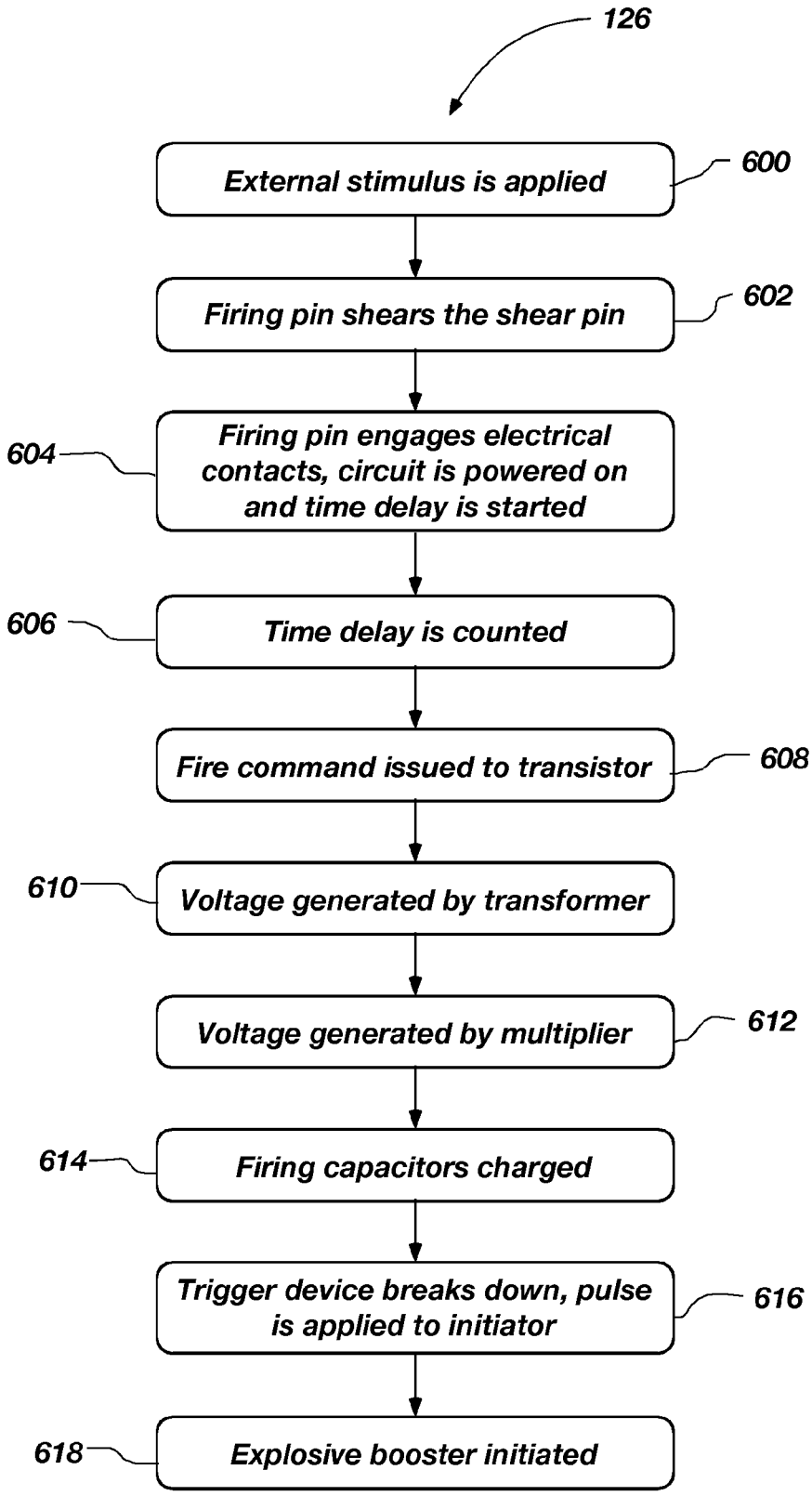
FIG. 6 is a flow diagram of an electronic time delay assembly according to an embodiment of the present invention.

FIG. 6 is a flow diagram of an embodiment of a method of operation of electronic time delay assembly 126. After a well perforation system is lowered down into a well and an oil or gas extraction process is ready to begin, as described above, an external force is applied 600 to the input module 206 located within a firing head. The external force acting on the firing pin of the input module 206 causes one or more shear pins to be sheared 602, which enables the firing pin to displace within input module 206 and to connect a battery to the electronic time delay circuit. The electronic time delay circuit is then powered on and the desired time delay 604 is started. After the oscillator, in conjunction with the counter device, counts the time delay 606, a fire command is issued to the gate of a high voltage generator transistor 608. Subsequently, a first voltage, which is substantially higher than the battery voltage, is generated by transformer 610. A voltage multiplier then generates a second voltage 612 which is substantially higher than the first intermediate voltage. The firing capacitors are then charged 614, and upon reaching a firing voltage, a trigger device breaks down and an electrical pulse is applied to an initiator 616 which then initiates an explosive booster 618.

Referring again to FIG. 2, after the well 10 has been pressure balanced during the time delay and the perforating gun 124 has been fired, producing formation fluids under formation pressure will rapidly flow out of formation 120 into isolated zone 116 through vent 140 and upward through the tubing string 136 toward the earth's surface.

Figure 7B:
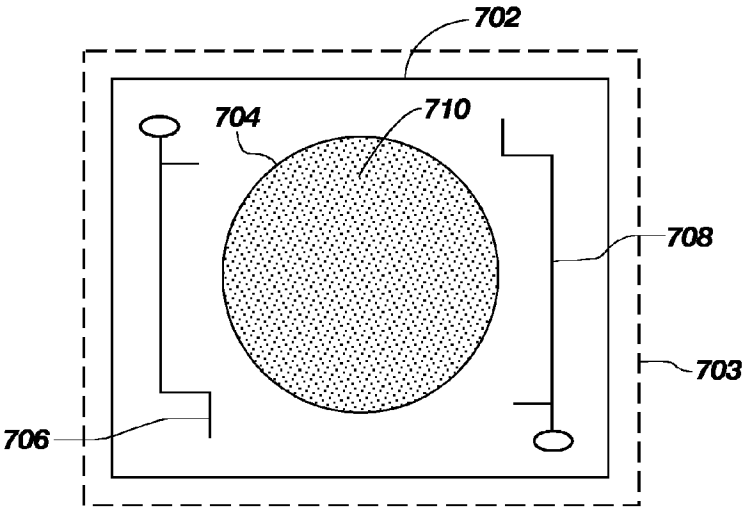
FIGS. 7A-7F illustrate a water shut-off component according to an embodiment of the invention.
Figure 7A:
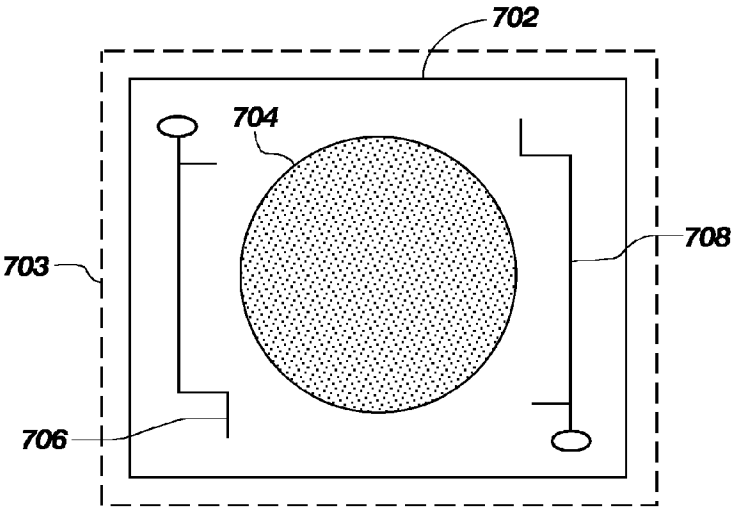

FIGS. 7A-7D and FIGS. 7E-7F, respectively, illustrate a top view and side view of a circuit isolation element 702 that may be incorporated into the electronic time delay circuit 212 described in reference to FIG. 5. Circuit isolation element 702 may be configured to, upon contact of a component thereof by water or any other liquid (such as, for example, drilling fluid or "mud"), electrically isolate circuitry operably coupled thereto from a power source. For brevity and ease of description, circuit isolation element 702 will be referred to herein as a water shut-off (WASH) component 702. As shown in FIG. 7A, WASH component 702 may include a WASH housing 703. For example only, WASH housing 703 may comprise a plastic housing and may be rated to withstand temperatures up to 180 degrees Celsius. Additionally, WASH component 702 may include a conductive input 706 and a conductive output 708. As described below in reference to FIG. 8, conductive input 706 may be operably coupled to battery 408 and conductive output 708 may be operably coupled to time delay circuit 212'. WASH component 702 may also include a pellet holder 704 configured to receive a pellet 710 (see FIGS. 7B-7D). Pellet 710 may, for example only, be attached to pellet holder 704 by an epoxy rated to withstand temperatures up to 260 degrees Celsius. For example only, pellet 710 may comprise a compressed, dehydrated cellulose sponge material having a diameter of 5 millimeters and a thickness in a compressed state between substantially 0.8-1.0 millimeter. Furthermore, the sponge material of pellet 710 may be configured to expand substantially in thickness upon coming into contact with water or any other liquid. For example only, pellet 710 may be configured to expand substantially ten times its compressed thickness upon exposure to a liquid.

Figure 7C:
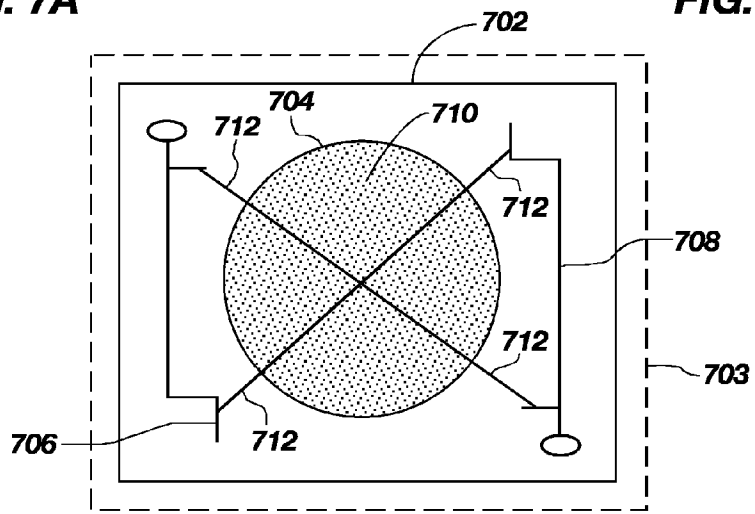

As shown in FIG. 7C, conductive input 706 and conductive output 708 may be operably coupled together via at least one wire 712 that is adjacent to and extends across pellet 710. For example only, and not by way of limitation, at least one wire 712 may comprise an aluminum bonding wire having a diameter of substantially 37 microns and rated for 1.0 ampere. As a non-limiting example, WASH component 702 may comprise two wires 712 adjacent to and extending across pellet 710 in a cross pattern, as is shown in FIG. 7C.

Figure 7D:
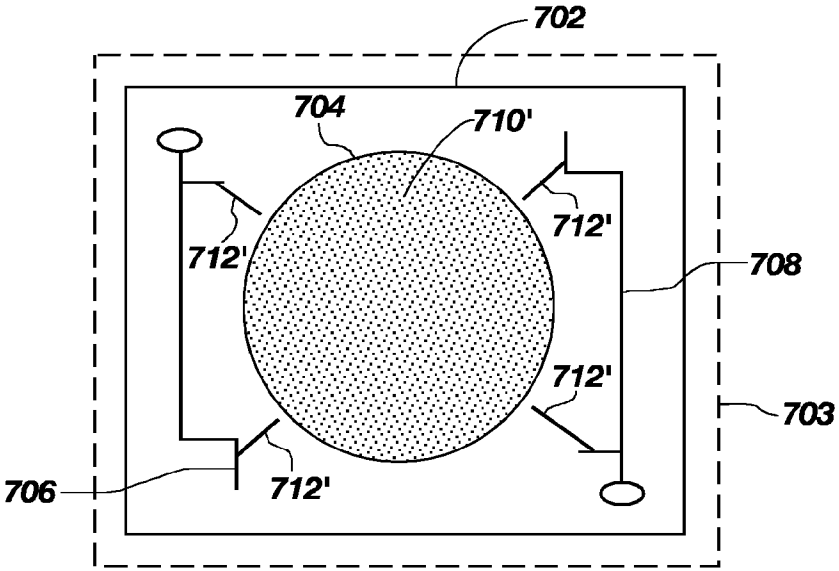
Figure 7F:
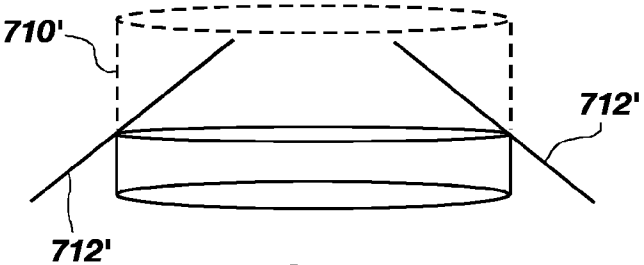
Figure 7E:
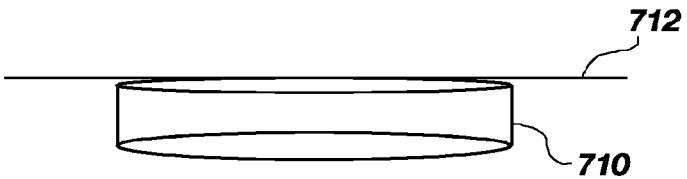

Upon exposure to a liquid, pellet 710 may be configured to expand toward wire(s) 712 and eventually break wire(s) 712, resulting in the configuration illustrated in FIGS. 7D and 7F. As shown in FIGS. 7D and 7F, pellet 710' has expanded, resulting in broken wires 712'. As a result, input 706 is electrically isolated from output 708.

Figure 8:
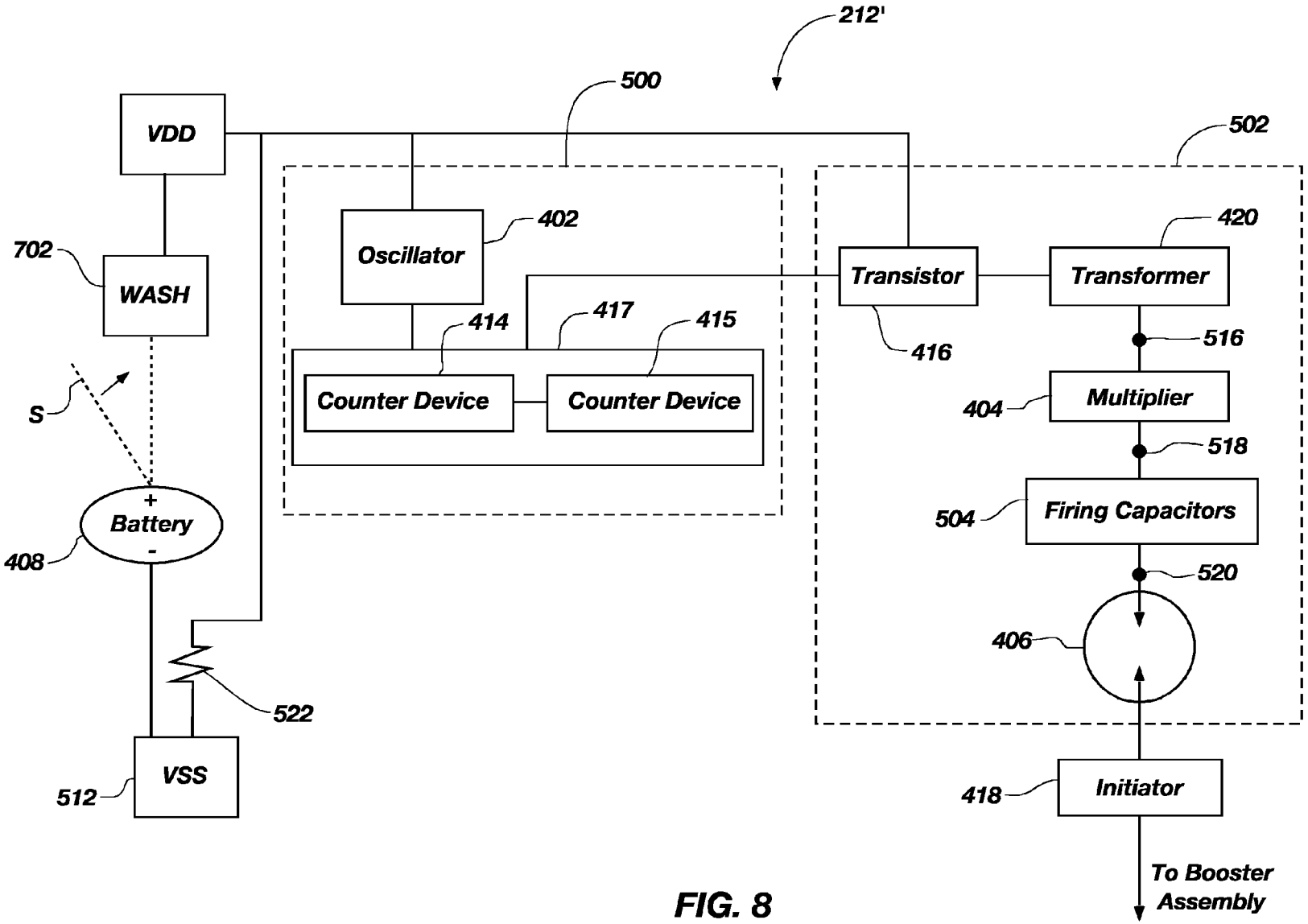
FIG. 8 is a block diagram of an electronic time delay circuit including a water shut-off component in accordance with an embodiment of the invention.

FIG. 8 illustrates a block diagram of electronic time delay circuit 212' implementing a WASH component 702 according to an embodiment of the present invention. Similarly to electronic time delay circuit 212 shown in FIG. 5, electronic time delay circuit 212' comprises an electronic time delay device 500 coupled with a voltage firing circuit 502. As such, the description above in reference to FIG. 5 regarding the configuration and operation of electronic time delay device 500, voltage firing circuit 502, and initiator 418 apply to electronic time delay circuit 212' as well. In addition, electronic time delay circuit 212' comprises WASH component 702 operably coupled between battery 408 and supply voltage terminal VDD. Battery 408 is selectively connectable to WASH component 702 by way of an electrical switch S provided by electrical contacts 304 in cooperation with pin contact 306 (see FIG. 4). When the pin contact 306 engages annular contact 304, battery 408 is connected to WASH component 702, thus connecting electronic time delay device 500 and voltage firing circuit 502 to battery 408.

A contemplated operation of circuit 212' utilizing WASH component 702 will now be described. After pin contact 306 within input module 206 engages both electrical contacts 304 (see FIG. 4), battery 408 is connected to the input 706 (see FIGS. 7A-7D) of WASH component 702. Wire(s) 702 operably couple input 706 to output 708, which is, in turn, operably coupled to supply voltage terminal VDD. Therefore, upon engagement of pin contact 306 and annular contact 304, battery 408 is connected to electronic time delay device 500 and voltage firing circuit 502, thus starting the desired, selected time delay. Upon contact by water or any other liquid with pellet 710, pellet 710 may expand toward wire(s) 712, come in contact with wire(s) 712, and eventually break wire (s) 712 resulting in broken wire(s) 712' (see FIGS. 7D and 7F). As a result, battery 408 is electrically de-coupled from electronic time delay device 500 and voltage firing circuit 502 and, therefore, timing delay circuit 212' is disabled. This feature provides enhanced safety to operators since it assures that an electronic time delay that is breached with a liquid will not be operational upon removal from the wellbore.

While embodiments of the electronic time delay apparatus of the present invention have been described and illustrated as having utility with a well perforating system, it is not so limited. For example, the electronic time delay apparatus of the present invention may be employed, in various embodiments, to initiate other explosive or propellant systems within a well bore, such as tubing or casing cutters. In addition, it is contemplated that embodiments of the electronic time delay apparatus of the present invention will find utility in subterranean mining and tunneling operations, in commercial, industrial and military demolition operations, in military ordnance, and otherwise, as will be readily apparent to those of ordinary skill in the relevant arts.

Specific embodiments have been shown by way of example in the drawings and have been described in detail herein; however, the invention may be susceptible to various modifications and alternative forms. It should be understood that the invention is not intended to be limited to the particular forms disclosed. Rather, the invention includes all modifications, equivalents, and alternatives falling within the spirit and scope of the invention as defined by the following appended claims.

What is claimed is:

1. A time delay apparatus, comprising:

an input assembly including an element configured to be displaced to enable a power source connection; and an electronic time delay circuit including an isolation element configured to electrically isolate a power source from the electronic time delay circuit upon contact of a component thereof by a liquid, the electronic time delay circuit operably coupled to the input assembly and configured to provide a time delay responsive to an enabled, non-isolated power source connection and initiate a fire command upon completion of the time delay.

2. The time delay apparatus of claim 1, wherein the isolation element comprises:

a conductive input operably coupled to the power source and configured to receive an electrical signal;

a conductive output operably coupled to the electronic time delay circuit and configured to output the electrical signal;

an expandable pellet located at least partially between the conductive input and the conductive output and configured to expand upon contacting a liquid; and at least one conductive wire operably coupled between the conductive input and the conductive output and adjacent to and extending across the expandable pellet.

3. The time delay apparatus of claim 2, wherein the expandable pellet comprises a compressed sponge.

4. The time delay apparatus of claim 3, wherein the expandable pellet has a diameter of substantially 5 (five) millimeters.

5. The time delay apparatus of claim 3, wherein the expandable pellet in a compressed state has a thickness in the range of substantially 0.8 to 1.0 millimeter.

6. The time delay apparatus of claim 2, wherein the at least one conductive wire comprises an aluminum wire having a 37-micron diameter.

7. The time delay apparatus of claim 2, further comprising a housing at least partially surrounding the isolation element.

8. The time delay apparatus of claim 7, wherein the housing comprises a plastic material rated to withstand temperatures up to 180 degrees Celsius.

9. The time delay apparatus of claim 2, wherein the expandable pellet is configured to come into contact with and break the at least one conductive wire as a result of expansion.

10. The time delay apparatus of claim 1, wherein the electronic time delay circuit comprises a quartz crystal oscillator operably coupled to at least one counter device.

11. The time delay apparatus of claim 10, wherein the quartz crystal oscillator comprises at least one of a 75 KHz quartz crystal oscillator, a 36 KHz quartz crystal oscillator, and a 26.5 KHz quartz crystal oscillator.

12. The time delay apparatus of claim 1, wherein the electronic time delay circuit comprises a voltage firing circuit including at least one of a voltage doubler and a voltage quadrupler configured to increase a voltage provided by a power source.

13. A well perforation system, comprising:

a conveyance device;

a perforating gun suspended from the conveyance device;

a firing head suspended from the conveyance device and operably coupled to the perforating gun;

a power source; and a time delay apparatus within the firing head, comprising:

an input assembly including an element configured to be displaced to enable a power source connection; and an electronic time delay circuit including an isolation element configured to electrically isolate the power source from the electronic time delay circuit upon contact of a component thereof by a liquid, the electronic time delay circuit operably coupled to the input assembly and configured to provide a time delay responsive to an enabled, non-isolated power source connection and initiate a fire command upon completion of the time delay.

14. The well perforation system of claim 13, wherein the isolation element comprises:

a conductive input operably coupled to the power source and configured to receive an electrical signal;

a conductive output operably coupled to the electronic time delay circuit and configured to output an electrical signal;

an expandable pellet located at least partially between the conductive input and the conductive output and configured to expand upon contacting a liquid; and at least one conductive wire operably coupled between the conductive input and the conductive output and adjacent to and extending across the expandable pellet.

15. The well perforation system of claim 14, wherein the expandable pellet comprises a compressed sponge.

16. The well perforation system of claim 15, wherein the expandable pellet has a diameter of substantially 5 (five) millimeters.

17. The well perforation system of claim 15, wherein the expandable pellet has a thickness in a compressed state in the range of substantially 0.8 to 1.0 millimeter.

18. The well perforation system of claim 14, wherein the at least one conductive wire comprises an aluminum wire having a 37-micron diameter.

19. The well perforation system of claim 14, further comprising a housing at least partially surrounding the isolation element.

20. The well perforation system of claim 14, wherein the expandable pellet is configured to come into contact with and break the at least one conductive wire as a result of expansion.

21. The well perforation system of claim 13, wherein the electronic time delay circuit comprises a quartz crystal oscillator operably coupled to at least one counter device.

22. The well perforation system of claim 21, wherein the quartz crystal oscillator comprises at least one of a 75 KHz quartz crystal oscillator, a 36 KHz quartz crystal oscillator, and a 26.5 KHz quartz crystal oscillator.

23. The well perforation system of claim 13, wherein the electronic time delay circuit comprises a voltage firing circuit including at least one of a voltage doubler and a voltage quadrupler configured to increase a voltage provided by a power source.

24. A method of disabling an electronic time delay circuit, comprising:

providing an isolation element connected between a power source and the electronic time delay circuit; and isolating the power source from the electronic time delay circuit responsive to a component of the isolation element contacting a liquid.

25. The method of claim 24, wherein isolating the power source from the electronic time delay circuit comprises expanding the component to break at least one wire.

* * * * *